United States Patent [19]

Holstein

[11] 4,232,500

[45] Nov. 11, 1980

[54] ROLL-ON CAPPER CHUCK

[75] Inventor: John H. Holstein, 5304 N. Colonial - No. 102, Fresno, Calif. 93704

[73] Assignee: John H. Holstein, Fresno, Calif.

[21] Appl. No.: 930,054

[22] Filed: Aug. 1, 1978

[51] Int. Cl.[3] ..... B65B 7/28; B67B 3/18

[52] U.S. Cl. ..... 53/334

[58] Field of Search ..... 53/334, 306, 331.5, 53/317, 314, 336, 338, 351, 353; 29/283, 516–519

[56] References Cited

U.S. PATENT DOCUMENTS

| | | | |
|---|---|---|---|
| 2,579,775 | 12/1951 | Allen et al. | 53/353 X |
| 3,895,478 | 7/1975 | Friendship | 53/334 X |
| 3,964,234 | 6/1976 | Hurst | 53/334 X |

FOREIGN PATENT DOCUMENTS

| | | | |
|---|---|---|---|
| 2290390 | 11/1974 | France | 53/334 |
| 247260 | 1/1960 | Netherlands | 53/334 |

*Primary Examiner*—Horace M. Culver

*Attorney, Agent, or Firm*—Hill, Van Santen, Steadman, Chiara & Simpson

[57] ABSTRACT

A capper chuck is disclosed for applying a closure cap to a container by conforming an annular skirt on the closure against an external conformation, such as a thread and pilfer ring, on the container. The capper chuck includes a plurality of support arms mounted on a rotatable housing for pivotal movement about pivot axes transverse to the axis of the housing, each support arm having a forming roller rotatably mounted thereon for movement to engage the skirt of the closure upon actuation of the support arms by an axial cam plunger. The forming roller support arms are adapted to accommodate oversize closure caps and containers without damaging the closure caps, containers or forming rollers.

3 Claims, 6 Drawing Figures

124
122
130
131
120
132
129
133
126
134
64
128
66
70
58a
66
60
58b
68
84
62
80
54
82
52
2
48
136
10
50
12
42
78
30
44
32
106
94
106
96
92a
94
92b
102
102
100
100
108
90b
98
88b
90a
14'
14
142
118
40
88a
114'
140
112
138
116a
114
118
20
18
24
38
22
46
26a
22a
26b
28
2

52
48
42
50
10
78
30
94
44
92a
12
102
108
100
90a
14
88a
112
116a
114
116b
118
40
18
46
24
28

148
30'
146
148
92'b
146
92'a
10'
42'

ROLL-ON CAPPER CHUCK

The present invention relates generally to apparatus for applying a closure cap to a container, and more particularly to a novel roll-on capper chuck adapted to apply a closure cap to a container by deforming an annular skirt on the closure cap against an external thread conformation or the like on the container, and having means adapted to accommodate oversize closure caps and containers without damaging the closure cap, container or capper chuck.

It is generally known to apply a closure cap onto an upper open neck end of a container by forming an annular depending skirt of the closure cap against an external conformation, conventionally an external thread or the like, formed peripherally of the open end of the container. In applying a tamper-proof closure cap to a container, the major length of the annular skirt of the closure cap is formed against an external thread conformation on the container by a thread forming roller, while the lower edge of the skirt is formed about an annular shoulder on the container juxtaposed to the thread conformation by a pilfer roller to define a pilfer ring. The pilfer ring portion of the closure cap is generally interconnected to the remaining skirt portion of the cap through frangible "bridges" such that when the closure cap is removed from the container, the bridges are ruptured indicating that the container has been opened.

In U.S. Pat. No. 3,878,667, dated Apr. 12, 1975, a closure cap applying apparatus is disclosed which employs a plurality of forming rollers each of which is carried on an actuating arm mounted for pivotal movement about an axis substantially parallel to the longitudinal axis of the capper chuck for movement between positions spaced radially outwardly from the axis of the chuck and inward positions operative to engage and deform the depending skirt of a closure cap against an underlying external conformation on a container. A toggle linkage arrangement is operative in response to an actuating rod to effect movement of the forming rollers between their operative and inoperative positions.

One of the primary objects of the present invention is to provide an improved roll-on capper chuck adapted to apply a closure cap to a container by forming an annular skirt on the closure cap against external conformations on the container, and wherein the influence of adverse rotational inertia forces on the forming rollers is minimized.

Another object of the present invention is to provide a roll-on capper chuck employing a plurality of support arms mounted on a housing for pivotal movement about axes transverse to the longitudinal axis of the housing, the support arms being moved between operative and inoperative positions by an axially movable actuating shaft cooperative with the forming roller support arms to effect selective movement thereof.

A feature of the roll-on capper chuck of the present invention lies in the provision of two or more support arms each of which has a forming roller carried on its lower end, each of the support arms having upper and lower portions pivotally connected to each other and having adjustable resilient means disposed between the upper and lower portions in a manner to facilitate adjustment of the forming rollers relative to the longitudinal axis of the housing and to accommodate slightly oversize closure caps without damaging the closure cap, underlying container or forming rollers.

In accordance with the present invention, a closure cap applying apparatus, alternatively termed a roll-on capper chuck, is provided wherein a plurality of support arms are mounted on a housing for pivotal movement about axes transverse to the longitudinal axis of the housing. The housing is adapted for rotation about its longitudinal axis and has an axially movable actuating shaft having an actuating cam thereon adapted to effect movement of the support arms between positions wherein forming rollers carried on the lower ends of the support arms are spaced outwardly from the annular skirt of a closure cap disposed interiorly of the forming rollers, and inward positions wherein the forming rollers engage the depending skirt portion of the closure cap and form the skirt against external thread and pilfer ring conformations on an underlying container. Each of the support arms includes pivotally connected upper and lower portions having adjustable resilient means interposed therebetween so as to accommodate closure caps which are slightly oversize from a nominal cap size without damage to the closure cap, underlying container or capper chuck. The various elements of the capper chuck of the present invention are configured to minimize the influence of rotational inertia on the forming rollers.

Further objects, features and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
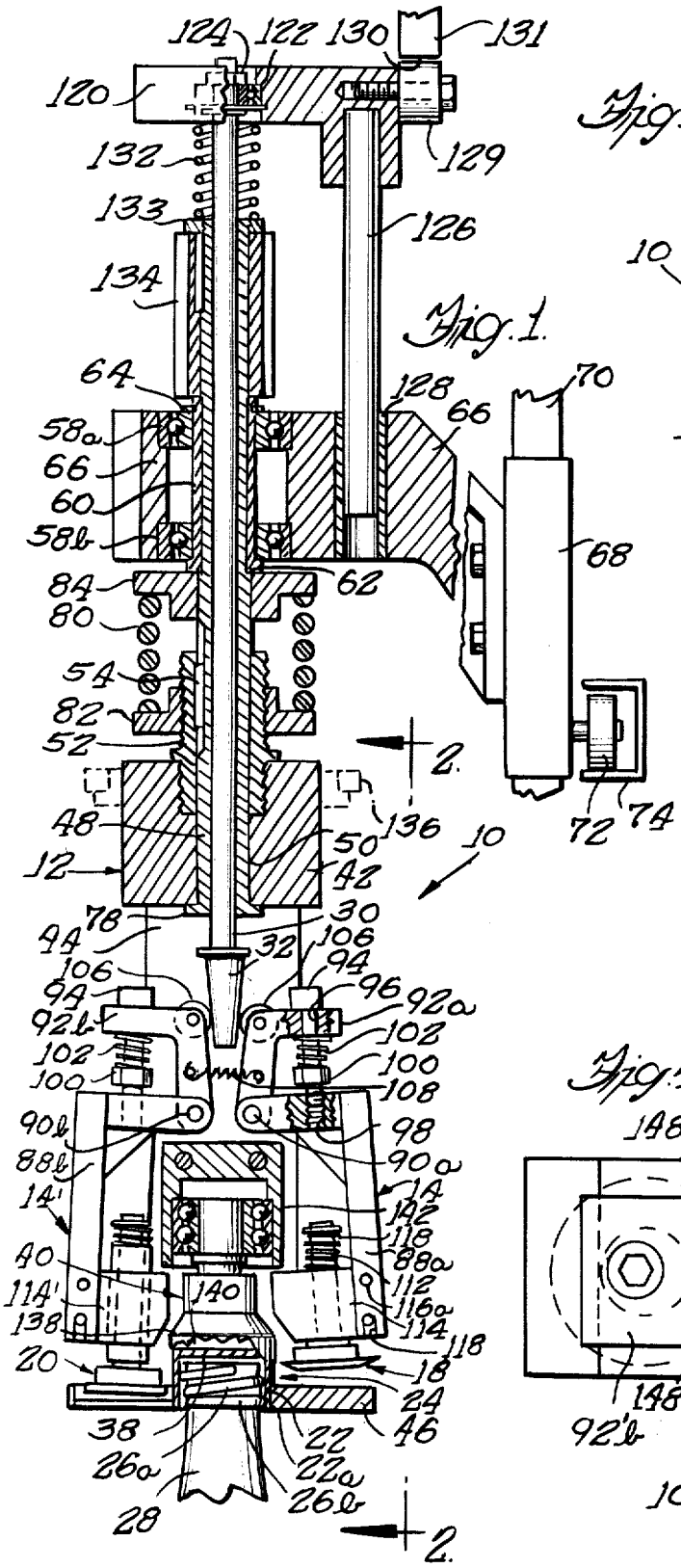
FIG. 1 is a fragmentary longitudinal sectional view of a roll-on capper chuck in accordance with the present invention in operative association with a closure cap and underlying container, but with the forming rollers spaced outwardly from the closure cap skirt.
Figure 2:
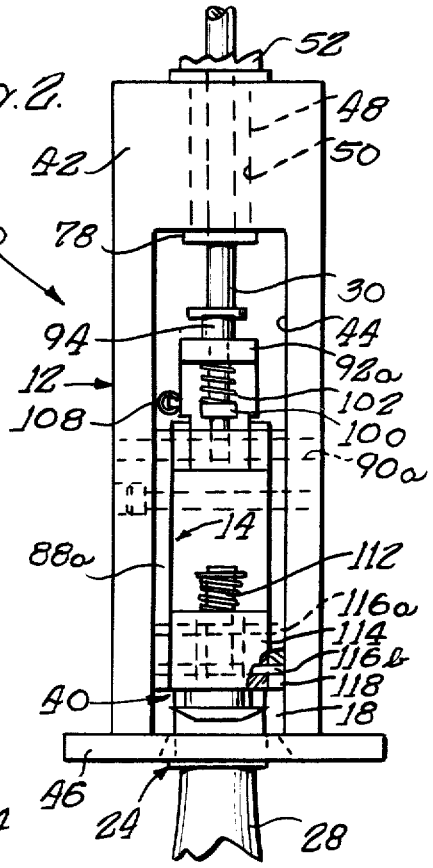
FIG. 2 is a fragmentary elevational view taken substantially along the line 2—2 of FIG. 1, looking in the direction of the arrows.

Referring now to the drawings, and in particular to FIGS. 1 and 2, apparatus for applying a closure cap to a container by roll-forming an annular skirt of the closure cap against an external conformation on a container is indicated generally at 10. Very generally, the apparatus 10, which may be termed a roll-on capper chuck, includes housing means 12 on which is mounted a pair of substantially identical support arms 14 and 14' for pivotal movement about pivot axes transverse to the longitudinal axis of the housing means. Each support arm 14 and 14' carries operating means in the form of a forming roller, indicated at 18 and 20, respectively, for movement between first outer positions relative to the longitudinal axis of the housing means, as shown in FIG. 1, and second inward positions relative to the longitudinal axis of the housing means wherein the rollers are operative to engage an annular skirt wall 22 of a closure cap 24 so as to form the annular skirt wall against an external helical thread conformation 26*a* and an annular pilfer ring 26*b* on the upper neck end of a container 28.

An actuating shaft 30 is mounted on the housing means 12 for axial movement relative to the housing means and has actuating means in the form of an actuating plunger cam 32 mounted thereon for operative association with the support arms 14 and 14' so that predetermined axial movement of the actuating shaft relative to the housing means 12 is operative to effect movement of the forming rollers 18 and 20 from their outer inoperative positions to their inward operating positions engaging the annular skirt 22 on the closure cap 24 to form the closure cap skirt against the conformations 26*a, b* during rotation of the housing means about its longitudinal axis. During forming of the closure cap skirt against the external conformations on the container, a closed upper end 38 of the closure cap is retained against the upper end of the container 28 by pressure head means, indicated generally at 40, axially aligned with and carried by the capper chuck housing means 12.

The housing means 12 preferably comprises a cylindrical housing 42 having a transverse opening or slot 44 therethrough in which the support arms 14 and 14' and pressure head means 40 are mounted. A circular plate 46 is mounted centrally on the lower end of the housing 42 normal to the longitudinal axis of the housing and has a circular opening 46*a* therethrough which serves to receive and center the neck of a bottle relative to the longitudinal axis of housing 42 during capping of the bottle.

The housing 42 is supported on a support sleeve 48 received through an axial bore 50 in the housing. A guide sleeve 52 has threaded connection to the housing 42 coaxial with the bore 50 and support sleeve 48. The guide sleeve 52 is keyed at 54 to the support sleeve 48 so as to effect rotation of housing 44 upon rotation of sleeve 48, the guide sleeve and housing being adapted for limited longitudinal movement along the support sleeve 48.

In the illustrated embodiment, the support sleeve 48 is supported in a vertical position by a pair of anti-friction bearings 58*a* and 58*b* the inner races of which are mounted on a sleeve 60 which, in turn, is fixed on the support sleeve 48 against an annular shoulder surface 62 by an annular retainer ring 64. The outer races of the bearings 58*a, b* are mounted within a support arm 66 fixed to a support block 68 which is vertically slidable on a pair of parallel vertical guide rods, one of which is shown at 70. The support block 68 has a cam follower roller 72 supported thereon which is received within and movable along a cam guide channel 74 having a predetermined elevational profile so as to effect selective vertical movement of the capper chuck as it is moved along the predetermined path in overlying relation to a conveyor (not shown) on which a plurality of containers 28 are moved in underlying axial alignment with corresponding roll-on capper chucks 10 during application of closure caps to the containers. The cam channel 74 is configured to effect predetermined downward movement of the capper chuck 10 to a position axially overlying a closure cap 24 and associated container 28 so that the pressure head means 40 engages the upper closed end 38 of the closure cap. Alternative means may be employed to effect predetermined vertical movement of the roll-on capper chuck 10 relative to an underlying axially aligned container and closure cap.

The housing 42 is slidable on the support sleeve 48 and is biased against an annular flange 78 on the lower end thereof by a coil compression spring 80 captured between an annular retainer plate 82 adjustably mounted on the guide sleeve 52 and an upper annular retainer plate 84 which abuts the lower end of the support sleeve 60. In this manner, if the support sleeve 48 is moved axially downwardly a predetermined distance by the support arm 68, and a corresponding downward movement of the housing 42 is prevented by engagement of the pressure head means 40 against a closure cap 24 and underlying container 28, the spring 80 will allow relative movement of the housing on the support sleeve 48. Such action serves to accommodate slightly different height containers during a capping operation and provides required sealing pressure between the top of the closure cap and the top of the underlying container.

The support arm 14 and 14' include first or lower portions 88*a* and 88*b*, respectively of generally inverted L-shape pivotally mounted on the housing 42 through pivot shafts 90*a*, 90*b*, respectively, disposed transverse to the longitudinal axis of the housing. Each support arm 14, 14' also includes an upper generally L-shaped arm portion 92*a*, 92*b*, respectively, mounted on an associated pivot shaft 90*a*, 90*b* and interconnected to its corresponding lower support arm portion 88*a*, 88*b* through an adjustable connecting screw 94. It is seen from FIG. 1 that each screw 94 is slidably received through a bore 96 in its associated support arm portion 92*a, b* and has threaded connection with a threaded bore 98 in the associated lower arm portion 88*a, b*. A nut 100 is adjustable on the threaded shank of each screw 94 and serves to capture a coil compression spring 102 between the nut and its associated support arm portion 92*a, b* so as to provide adjustable resilient connection between the upper and lower arm portions of each support arm 14, 14'.

Each of the upper support arm portions 92*a, b* rotatably supports a contact roller 106 for engagement with the actuating plunger cam 32 on the actuating shaft 30. The contact rollers 106 are biased against the actuating can 32 by a coil tension spring 108 having its opposite end connected to the upper arms 92*a, b*, as best seen in FIGS. 1 and 2. It will be appreciated that because the upper and lower support arm portions 92*a, b* and 88*a, b* are interconnected, the tension spring 108 also serves to bias the lower arms 88*a, b* to outer pivotal positions relative to the longitudinal axis of the roll-on capper chuck.

The forming roller 18 is mounted on a lower bifurcated end of the support arm 14 and is of known design. The forming roller 18 is rotatably supported on a support shaft 112 which is supported by and axially movable relative to a mounting block 114 releasably connected to the lower bifurcated end of the support arm 14 through a removable connecting pin 116*a* received within axial aligned openings in the support arm and mounting block, and a roll pin 116*b* fixed within a suitable bore in mounting block 114 and adapted for registration with open ended slots 118 formed in the lower bifurcated ends of the associated support arm 14. The forming roller 18 is adapted to engage the annular skirt wall 22 of closure cap 24 and deform it against the external thread conformation 26*a* on the container 28 when forming roller 18 is moved to its inward operating position and the capper chuck is rotated. The roller support shaft 112 is normally biased to an upward position relative to its mounting block 114 by a coil compression spring 118 which is selected to allow forming roller 18 to circumferentially follow the downwardly helical thread conformation 26*a* on the container during rotation of the capper chuck about its longitudinal axis. The forming roller 18 and the manner of mounting it on the support block 114 are substantially similar to the mounting of the roller identified by reference numeral 100 in U.S. Pat. No. 3,878,667, dated Apr. 22, 1975. The axis of rotation of the roller 18 is preferably inclined from a plane containing the longitudinal axis of the capper chuck housing 42 by an angle approximately equal to the pitch angle of the helical portion of the thread conformation 26*a* on the container on which closure cap 24 is being applied.

The forming roller 20 is mounted on a lower bifurcated end of the support arm 14' through a support block 114' in a manner similar to the forming roller 18, except that the axis of rotation of forming roller 20 is not inclined from vertical as is the axis of forming roller 18. The forming roller 20 is identical to the forming roller identified at reference numeral 104 in the aforenoted U.S. Pat. No. 3,878,667. The forming roller 20 serves to curl the lower free edge 22*a* of the annular skirt wall 22 on closure cap 24 inwardly beneath the annular bead conformation 26*b* on the container 28 so as to establish a pilfer ring connection of the closure cap to the container.

To effect predetermined axial movement of the actuating shaft 30 and actuating plunger cam 32 relative to the housing 42 and roller support arms 14, 14', the upper end of the actuating shaft is secured to and rotatable within a thrust block 120 through a suitable bearing 122 and nut 124. The thrust block 120 has a depending guide rod 126 secured thereto which is slidably received within a bearing sleeve 128 mounted within the support arm 66 to maintain the thrust block in predetermined relation to the support arm 66. A cam follower roller 129 is rotatably mounted on the thrust block 120 for engagement with a cam surface 130 formed on an actuator cam plate 131. The cam follower 129 is urged upwardly against the cam surface 130 by a compression spring 132 disposed between the thrust block 120 and a nut 133 secured on the upper end of support sleeve 48. The cam surface 130 has a predetermined elevational profile relative to the cam guide channel 74 so as to effect predetermined axial movement of the actuating shaft 30 relative to the housing 42 during a capping operation, as will become more apparent hereinbelow.

To effect rotation of the housing 42 and associated roller support arms 14 and 14' about the axis of the actuating shaft 30, a pinion gear 134 is fixed on the upper end of the support sleeve 48 which, as noted, supports the capper chuck housing 44 and is rotatable relative to the support arm 66. The drive pinion 134 may be connected directly to a drive gear or through a gear train to effect selective rotation of the capper chuck.

As an alternative to internal driving of the capper chuck through the pinion gear 134, the housing 42 may have an annular drive ring, shown in phantom at 136 in FIG. 1, mounted thereon adapted to be engaged by a friction plate as the capper chuck is moved along a predetermined path so as to effect selective rotation of the capper chuck during a capping operation.

During a capping operation, the roll-on capper chuck 10 may be moved along a predetermined path defined by the cam guide channel 74 in coordinated relation with movement of a container 28 having a closure cap shell or blank 24 received over its upper threaded neck end. When the capper chuck is axially aligned with an underlying container and closure cap, the support arm 68 is caused to move downwardly to lower the capper chuck to a position wherein the pressure head means 40 engages the upper end of the closure cap. For this purpose, the pressure head means 40 includes a pressure block 138 having a recess 140 in its lower surface adapted to receive the upper end of the closure cap therein, the pressure block 138 being rotatably mounted within the housing 42 through a suitable anti-friction bearing 142 in substantially identical fashion to mounting of the pressure head block in the aforenoted U.S. Pat. No. 3,878,667.

After the roll-on capper chuck has moved to a downward position engaging the closure cap 24 against the upper end of the underlying container, the actuating shaft 30 is caused to move axially downwardly a predetermined distance sufficient to cause the actuating cam 32 to effect inward pivotal movement of the support arms 14 and 14' so that the forming rollers 18 and 20 engage the annular skirt 22 of the closure cap. As the forming rollers move radially inwardly to engage the closure cap skirt 22, the capper chuck is caused to rotate, either through the internal drive pinion 134 or external drive ring 136, to cause the forming rollers 18 and 20 to roll around the full circumference of the upper neck of the underlying container during which the forming roller 18 forms the closure cap skirt 22 against the helical thread conformation 26*a*, while the pilfer ring forming roller 20 forms the lower edge 22*a* of the annular skirt into underlying relation to the annular bead conformation 26*b*.

It will be understood that the actuating plunger cam 32 may have different external configurations than that shown in FIG. 1 so as to provide the desired magnitude of inward pivotal movement of the forming rollers 18 and 20 as well as the desired rate of movement of the forming rollers.

Figure 4:
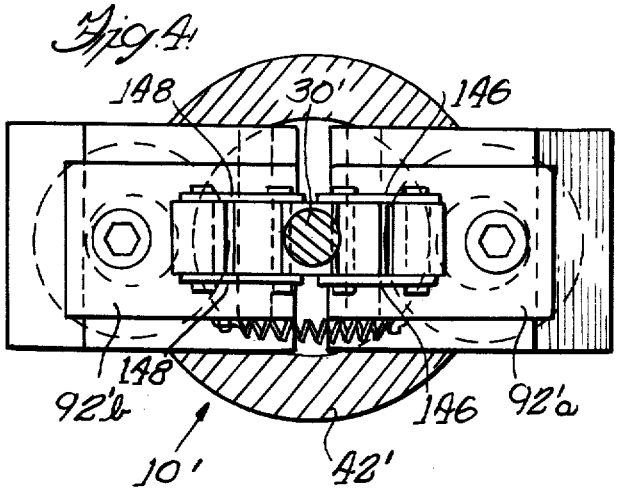
FIG. 4 is a transverse sectional view taken substantially along the line 4—4 of FIG. 3, looking in the direction of the arrows.
Figure 3:
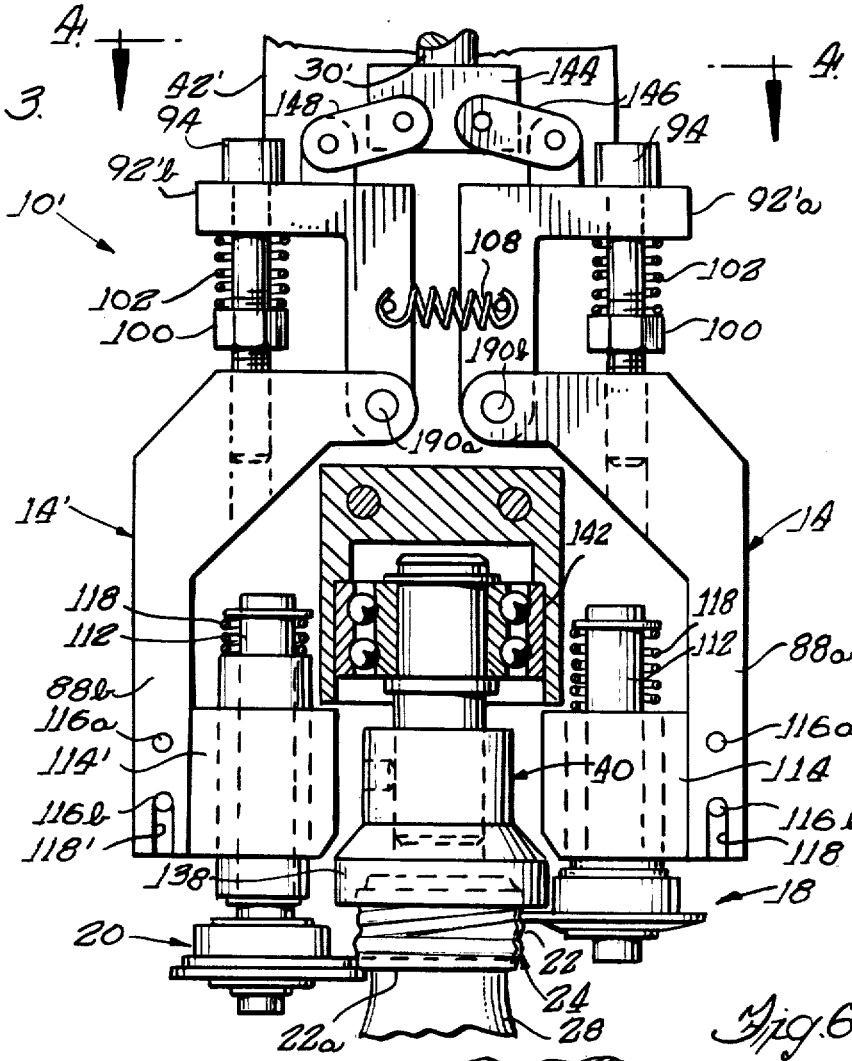
FIG. 3 is an enlarged fragmentary view, partly in longitudinal section, of an alternative capper chuck in accordance with the present invention having its forming rollers shown in inward operative relation with the depending annular skirt of a closure cap disposed on a container.

FIGS. 3 and 4 illustrate an alternative embodiment of a roll-on capper chuck, indicated generally at 10', in accordance with the present invention which employs slightly different means carried by the actuating shaft 30' for cooperation with the support arms 14 and 14' to effect movement of the associated forming rollers 18 and 20 from their first outer positions to their second inner positions during axial downward movement of the actuating shaft 30'. In the embodiment of FIGS. 3 and 4, a connecting block 144 is secured on the lower end of the actuating shaft 30' and is connected to upper arm portions 92'*a* and 92'*b* of support arms 14 and 14' through pairs of identical toggle links 146 and 148 so that longitudinal movement of actuating shaft 30' relative to the housing 42' effects controlled inward and outward pivot movement of the forming rollers 18 and 20 relative to the longitudinal axis of the capper chuck housing.

Figure 6:
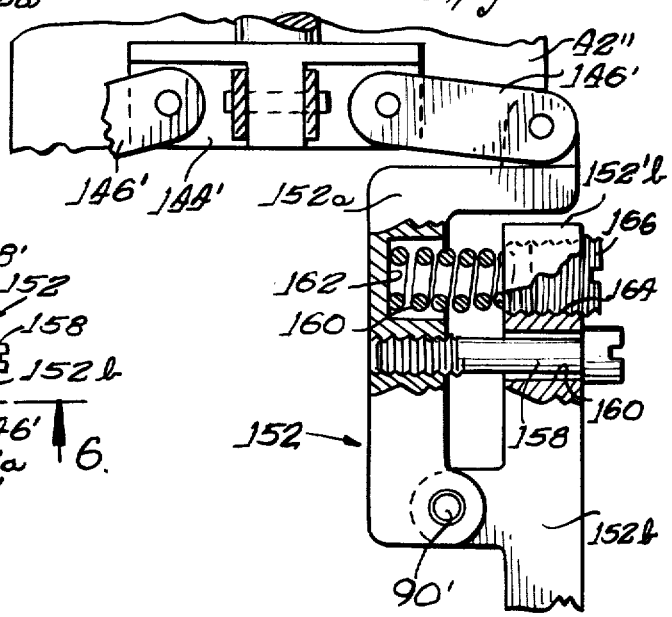
FIG. 6 is a fragmentary longitudinal view taken substantially along line 6—6 of FIG. 5, looking in the direction of the arrows.
Figure 5:
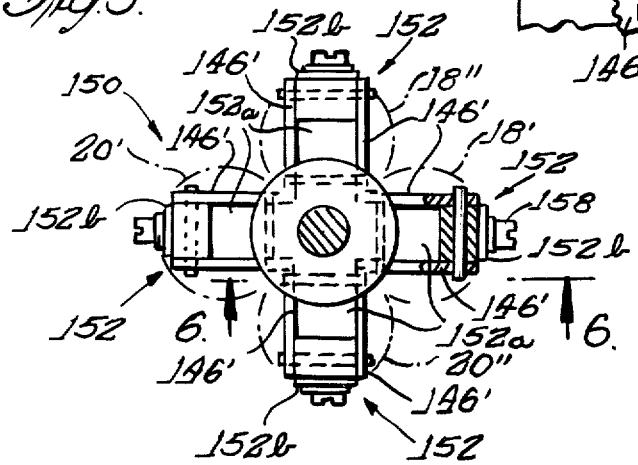
FIG. 5 is a fragmentary transverse sectional view similar to FIG. 4 but illustrating on a smaller scale an alternative roll-on capper chuck adapted for use with four forming rollers.

FIGS. 5 and 6 illustrate, in fragmentary section views, a further embodiment of a roll-on capper chuck, indicated generally at 150, constructed in accordance with the present invention. The roll-on capper chuck 150 may be generally similar to the aforedescribed roll-on capper chuck 10' except that it employs slightly different forming roller support arms and also employs two thread forming rollers 18' and 18'' and two pilfer ring forming rollers 20' and 20''. The thread forming rollers 18' and 18'' are identical to the forming roller 18 while the pilfer ring forming rollers 20' and 20'' are identical to the aforedescribed forming roller 20. The rollers 18', 18'', 20' and 20'' are supported on separate but substantially identical support arm assemblies, each of which is indicated generally at 152, mounted on the housing 42'' through pivot shafts, one of which is shown at 90' in FIG. 6, for pivotal movement about axes transverse to the longitudinal axis of the capper chuck.

Each of the support arms 152 includes a generally C-shaped upper portion **152*a* and a generally T-shaped lower arm portion 152*b*. The upper and lower arm portions 152*a* and 152*b* are pivotally mounted on the common pivot shafts 90' for pivotal movement relative to each other as well as pivotal movement relative to the housing 42''. Each of the upper support arm portions 152*a* is pivotally connected to an axially movable mounting block 144' through a pair of toggle links 146' pivotally connected at their opposite ends to the mounting block 144' and to an upstanding tab on the corresponding arm portion 152*a***.

The upper and lower support arm portions **152*a* and 152*b* of each support arm 152 are interconnected to each other through adjustable resilient connections which enable relative adjustment for different nominal size closure caps, and which also accommodate closure caps of slightly larger diameter than the nominal diameter for which the support arms and forming rollers are initially adjusted so that the closure caps, underlying container and capper chuck are not damaged. To this end, a connecting screw 158 is freely received through a suitable bore 160 formed in an upper projection 152'*b* on each support arm portion 152*b* and has threaded connection with the associated upper arm portion 152*a*, as best seen in FIG. 6. The screw 158 is adjustable to draw the arm portion 152*a* toward the arm portion 152'*b* and thus adjust the angular relation of the lower support arm portion 152*b* relative to the upper arm portion 152*a***.

A compression spring 160 has one end received within a suitable cylindrical recess 162 formed in the upper support arm portion **152*a* and has its opposite end received in a threaded bore 164 in the upper arm portion 152'*b* in which is threadedly mounted an adjustable nut 166. The spring 160 serves to bias the arm portions 152*a* and 152'*b* apart so as to normally maintain the arm portion 152'*b* against the head of the screw 158. The biasing force of spring 160 may be varied by adjustment of nut 166 within the threaded bore 164. In other respects the capper chuck 150 is structurally and operatively similar to the aforedescribed capper chuck 10'** and may be rotated above its longitudinal axis through an internal pinion drive or through an external rim drive.

It will be appreciated that the capper chuck as fragmentarily illustrated in FIGS. 5 and 6 could be modified to provide two thread forming rollers and a single pilfer ring forming roller as desired. In the latter case, the various forming rollers would be carried on separate support arms, such as illustrated at 152, equidistantly spaced about the axis of the capper chuck.

While the capper chuck of the present invention has been illustrated and described in conjunction with applying a closure to a container by roll forming an annular skirt of the closure against external conformations of the container, the structural arrangement for actuating the forming roller support arms may also find other applications. For example, in applications wherein a roll seam is formed between an annular wall and an end plate by rolling a free edge of the wall over the peripheral edge of the end plate, such as in relatively low voltage cylindrical batteries, one or more forming rollers of the type exemplified by pilfer rollers 20 and 20' may be employed with the apparatus 10 to effect such roll seaming.

It will thus be understood by those skilled in the art that while preferred embodiments of the roll-on capper chuck in accordance with the present invention have been illustrated and described, changes and modifications may be made therein without departing from the invention in its broader aspects.

Various features of the invention are defined in the following claims.

What is claimed is:

1. In a capper chuck apparatus having housing means, at least two support arms pivotally mounted on said housing means, operating means carried by said support arms and adapted to engage a closure disposed between said operating arms, and means operatively associated with said housing means and said support arms and operative to effect pivotal movement of said support arms between first positions wherein said operating means engage a closure disposed therebetween and second positions wherein said operating means are spaced from the closure, the improvement wherein each of said support arms has a bifurcated end thereon opposite its pivotal connection to said housing means, each of said support arms having a pair of laterally aligned open ended slots formed in its bifurcated end and a pair of axially aligned openings spaced from said slots, each of said operating means including a mounting block adapted to be received within the bifurcated end of the associated support arm, each of said mounting blocks having a first pin therein adapted for registration with the open ended slots in the associated support arm and having a second pin therein adapted to be inserted through said axially aligned openings in the associated support arm so as to releasably retain the operating arm in assembled relation with its associated support arm.

2. The improvement as defined in claim 1 wherein said first and second pins are disposed in parallel relation.

3. The improvement as defined in claim 1 wherein said second pin is releasably retained within a bore formed in said support arm.

* * * * *